US006058914A

United States Patent [19]

Suzuki

[11] Patent Number: 6,058,914

[45] Date of Patent: May 9, 2000

[54] COMBUSTION PROMOTION AUXILIARY DEVICE FOR INTERNAL COMBUSTION ENGINE

[75] Inventor: Isao Suzuki, Toshima-ku, Japan

[73] Assignees: Brainworks Co., Ltd., Tokyo; Hiroaki Hoshino, Shirakawa, both of Japan

[21] Appl. No.: 09/107,324

[22] Filed: Jun. 30, 1998

[30] Foreign Application Priority Data

Jun. 30, 1997 [JP] Japan ..... 9-190561

[51] Int. Cl.[7] ..... F02M 27/04

[52] U.S. Cl. ..... 123/538

[58] Field of Search ..... 123/536, 537, 123/538

[56] References Cited

U.S. PATENT DOCUMENTS 4,357,237 11/1982 Sanderson ..... 123/538
5,460,144 10/1995 Park et al. .
5,487,370 1/1996 Miyazaki ..... 123/538
5,632,254 5/1997 Kim .
5,664,546 9/1997 De La Torre Barreiro ..... 123/538

*Primary Examiner*—Marguerite McMahon
*Attorney, Agent, or Firm*—Wenderoth, Lind & Ponack, L.L.P.

[57] ABSTRACT

A combustion promotion auxiliary device can increase the fuel consumption rate by improving the fuel combustion efficiency for a variety of internal combustion engines including those for automobiles and motorbikes, and can prevent air pollution. The combustion promotion auxiliary device includes a combustion promotion auxiliary container which can be mounted to a fuel pipe for an internal combustion engine and a combustion promotion medium consisting of soft porous ancient marine humus housed in the combustion promotion auxiliary container.

7 Claims, 5 Drawing Sheets

Molecular structure of gasoline before passing combustion promotion auxiliary device Molecular structure of gasoline after passing combustion promotion auxiliary device

COMBUSTION PROMOTION AUXILIARY DEVICE FOR INTERNAL COMBUSTION ENGINE

BACKGROUND OF THE INVENTION

1. Field of the Invention

This invention relates to a combustion promotion auxiliary device for internal combustion engines that is suitable for use with combustion engines for automobiles, motorbikes, boilers, and others.

2. Prior Art

Conventionally, the CO, HC, and NOx in the exhaust gas from the engine for an automobile and a motorbike have had an ill effect on the human body, and presented an environmental problem such as air pollution.

The automobile manufacturers are going to cope with this problem by improving the engine, however, a vast amount of money is required for improvement of an engine, and it is not always easy to provide a substantial improvement in solving the environmental problem such as air pollution.

The users of automobiles and motorbikes are always requesting that the fuel consumption rate is as good as possible.

SUMMARY OF THE INVENTION

The present invention has been developed in consideration of the above conventional situation, and intends to offer a combustion promotion auxiliary device that can increase the fuel consumption rate by improving the fuel combustion efficiency for a variety of internal combustion engines including those for automobiles and motorbikes, and can prevent air pollution.

The combustion promotion auxiliary devices for internal combustion engines that are related to the present invention are characterized in that they have a combustion promotion auxiliary container 1 which can be mounted to the fuel pipe 11 for an internal combustion engine and a combustion promotion medium 2 consisting of soft porous ancient marine humus housed in the combustion promotion auxiliary container 1.

DETAILED DESCRIPTION OF THE INVENTION

Figure 1:
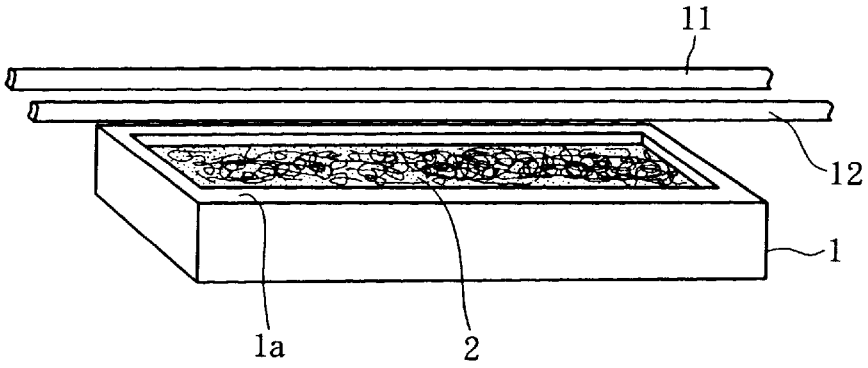
FIG. 1 is a schematic configuration of the combustion promotion auxiliary device for internal combustion engines of a first embodiment.

The combustion promotion auxiliary device for internal combustion engines that is related to the invention is characterized in that it has a combustion promotion auxiliary container which can be mounted to the fuel supply system in a variety of internal combustion engines for automobiles, motorbikes, and others, and a combustion promotion medium consisting of soft porous ancient marine humus housed in this combustion promotion auxiliary container.

With this invention, the far infrared rays radiating action of the combustion promotion medium consisting of soft porous ancient marine humus housed in the combustion promotion auxiliary container aligns the molecular structure of the fuel, by which increasing the fuel consumption rate by improving the fuel combustion efficiency for a variety of internal combustion engines including those for automobiles and motorbikes can be achieved, and preventing air pollution by reducing the exhaust can also be achieved.

The combustion promotion auxiliary device for internal combustion engines that is related to the invention is characterized in that it has a combustion promotion auxiliary container which can be mounted to the fuel supply system in a variety of internal combustion engines for automobiles, motorbikes, and others, and a combustion promotion medium consisting of soft porous ancient marine humus and ceramic powder housed in this combustion promotion auxiliary container.

With this invention, the far infrared rays radiating action of the soft porous ancient marine humus and that of the ceramic powder housed in the combustion promotion auxiliary container align the molecular structure of the fuel, by which increasing the fuel consumption rate by improving the fuel combustion efficiency for a variety of internal combustion engines including those for automobiles and motorbikes can be achieved, and preventing air pollution by reducing the exhaust can also be achieved.

The combustion promotion auxiliary device for internal combustion engines that is related to the invention is characterized in that it has a combustion promotion auxiliary container which can be mounted to the fuel supply system in a variety of internal combustion engines for automobiles, motorbikes, and others, and a combustion promotion medium consisting of soft porous ancient marine humus and a magnet housed in this combustion promotion auxiliary container.

With this invention, the far infrared rays radiating action of the soft porous ancient marine humus and the magnetic field action of the magnet housed in the combustion promotion auxiliary container align the molecular structure of the fuel, by which increasing the fuel consumption rate by improving the fuel combustion efficiency for a variety of internal combustion engines including those for automobiles and motorbikes can be achieved, and preventing air pollution by reducing the exhaust can also be achieved.

The combustion promotion auxiliary device for internal combustion engines that is related to the invention is characterized in that it has a combustion promotion auxiliary container which can be mounted to the fuel supply system in a variety of internal combustion engines for automobiles, motorbikes, and others, and a combustion promotion medium consisting of soft porous ancient marine humus, ceramic powder, and a magnet housed in this combustion promotion auxiliary container.

With this invention, the far infrared rays radiating action of the soft porous ancient marine humus, that of the ceramic powder, and the magnetic field action of the magnet housed in the combustion promotion auxiliary container align the molecular structure of the fuel, by which increasing the fuel consumption rate by improving the fuel combustion efficiency for a variety of internal combustion engines including those for automobiles and motorbikes can be achieved, and preventing air pollution by reducing the exhaust can also be achieved.

The combustion promotion auxiliary device for internal combustion engines that is related to the invention is characterized in that it has a combustion promotion auxiliary container which can be mounted to the fuel supply system in a variety of internal combustion engines for automobiles, motorbikes, and others, the top of which is opened, and whose inside is partitioned into more than one area with a certain spacing, providing magnet accommodating sections; and a combustion promotion medium consisting of soft porous ancient marine humus sectioned and housed in areas other than said magnet accommodating sections in this combustion promotion auxiliary container, and magnetic plates housed in said magnet accommodating sections.

With this invention, the far infrared rays radiating action of the soft porous ancient marine humus housed in the combustion promotion auxiliary container, and the magnetic field action of the magnet plates arranged with a certain spacing in said magnet accommodating sections align the molecular structure of the fuel, by which increasing the fuel consumption rate by improving the fuel combustion efficiency for a variety of internal combustion engines including those for automobiles and motorbikes can be achieved, and preventing air pollution by reducing the exhaust can also be achieved. In addition, the magnetic field action of the magnet plates arranged with a certain spacing in said magnet accommodating sections allows this combustion promotion auxiliary container itself to be directly attached to the fuel supply system made of a magnetic material for an internal combustion engine, thus providing convenience for a mounting operation.

The combustion promotion auxiliary device for internal combustion engines that is related to the invention is characterized in that it has a combustion promotion auxiliary container which can be mounted to the fuel supply system in a variety of internal combustion engines for automobiles, motorbikes, and others, the top of which is opened, whose inside is partitioned into more than one area with a certain spacing, providing magnet accommodating sections, and which has a gasket made of rubber and laid on the internal wall of these magnet accommodating sections; a combustion promotion medium consisting of soft porous ancient marine humus sectioned and housed in areas other than said magnet accommodating sections in this combustion promotion auxiliary container, and magnetic plates housed in said magnet accommodating sections; and a lid to cover the opening of the top of the opening of the combustion promotion auxiliary container in which this combustion promotion medium is housed.

With this invention, the far infrared rays radiating action of the soft porous ancient marine humus housed in the combustion promotion auxiliary container, and the magnetic field action of the magnet plates arranged with a certain spacing in said magnet accommodating sections align the molecular structure of the fuel, by which increasing the fuel consumption rate by improving the fuel combustion efficiency for a variety of internal combustion engines including those for automobiles and motorbikes can be achieved, and preventing air pollution by reducing the exhaust can also be achieved. In addition, the magnetic field action of the magnet plates arranged with a certain spacing in said magnet accommodating sections allows this combustion promotion auxiliary container itself to be directly attached to the fuel supply system made of a magnetic material for an internal combustion engine, thus providing convenience for a mounting operation.

Further, a gasket made of rubber is laid on the internal wall of said magnet accommodating sections, and a rectangular lid made of copper is provided to cover the opening of the combustion promotion auxiliary container, thus, the magnet plates in said magnet accommodating sections can be held in place, and by bringing the lid into tight contact with the gasket made of rubber, rainwater and other foreign matters entering the magnet accommodating sections can be prevented.

The combustion promotion auxiliary device for internal combustion engines that is related to the invention is characterized in that it has a combustion promotion auxiliary container which can be mounted to the fuel supply system in a variety of internal combustion engines for automobiles, motorbikes, and others, the top of which is opened, whose inside is partitioned into more than one area with a certain spacing, providing magnet accommodating sections, and which has a gasket made of rubber and laid on the internal wall of these magnet accommodating sections; a combustion promotion medium consisting of soft porous ancient marine humus sectioned and housed in areas other than said magnet accommodating sections in this combustion promotion auxiliary container, and magnetic plates housed in said magnet accommodating sections; a lid to cover the opening of the top of the opening of the combustion promotion auxiliary container in which this combustion promotion medium is housed; and band fittings to mount said combustion promotion auxiliary container covered with this lid to the fuel supply system for an internal combustion engine.

With this combustion promotion auxiliary device, the same function as that of the invention as stated above is obtained, and band fittings for mounting the combustion promotion auxiliary container to the fuel supply system for an internal combustion engine are provided, thus, if pipes or others composing the fuel supply system for said internal combustion engine are made of such a non-magnetic material as rubber, the band fittings can be used to easily mount this combustion promotion auxiliary device to the fuel supply system.

Here is a detailed description of the combustion promotion auxiliary device for internal combustion engines that is related to embodiments of the present invention.

(First Embodiment)

The combustion promotion auxiliary device for internal combustion engines that is related to the first embodiment of the present invention has a combustion promotion auxiliary container 1 that is mounted to the fuel supply system for an internal combustion engine and has an opening 1*a* on one side, and a combustion promotion medium 2 consisting of soft porous ancient marine humus, ceramic powder, and a magnet housed in this combustion promotion auxiliary container 1.

The above combustion promotion medium 2, in addition to the above embodiment, may also be a combustion promotion medium 2 consisting of only soft porous ancient marine humus, a combustion promotion medium 2 consisting of a combination of soft porous ancient marine humus with ceramic powder, or a combustion promotion medium 2 consisting of a combination of soft porous ancient marine humus with a magnet.

Installation of the combustion promotion auxiliary device is made by using such fittings as clamps (not shown) to mount the combustion promotion auxiliary container 1 to the place where, for example, a fuel pipe 11 and a return pipe 12 are mounted in parallel with each other under the car body of an automobile.

Said opening 1*a* is hermetically sealed with an appropriate lid or other to prevent rainwater and other foreign matters from entering the inside.

Next, said soft porous ancient marine humus, ceramic powder, and magnet will be described in detail here.

With the present embodiment, as described with regard to further embodiments, soft porous ancient marine humus, which is a substance plentifully providing far infrared radiation, ceramic powder, which provides far infrared radiation, and a magnet are housed in said combustion promotion auxiliary container 1.

The combustion promotion auxiliary container 1 is made of stainless steel to prevent deterioration, and a copper plate is used for the inner peripheral partition wall.

The magnet is coated with nickel to prevent corrosion. The ceramic powder provides more far infrared radiation as the temperature rises. The copper plate in the combustion promotion auxiliary container 1 has a good thermal conductivity, allowing heat to be quickly transferred to the ceramic powder.

Because soft porous ancient marine humus, which is a substance plentifully providing far infrared radiation, is used, and the ceramic powder used is excellent in far infrared radiation, they synergistically and effectively act on the fuel flowing through the fuel pipe 11 and the return pipe 12. In other words, the far infrared radiation makes the clusters (masses of molecules) containing carbon (C) and hydrogen (H) in the fuel structure fine to provide a uniform cluster structure, thus increasing the combustion efficiency.

The magnet sealed together with the others stabilizes the installation, and the magnetic field acts so as to make the fuel structure uniform, thus providing a synergistic effect with the far infrared radiation from the soft porous ancient marine humus and the ceramic powder.

Next, the soft porous ancient marine humus, which is a substance plentifully providing far infrared radiation, will be described.

For this soft porous ancient marine humus, Table 1 gives the analysis parameters, Table 2 the analyzing method, and Table 3 the analysis results.

[Table 1]

Analysis items (1) Specific surface area measurement
(2) Pore volume measurement
(3) Average pore radius
(4) Moisture content
(5) Ignition loss
(6) Aluminum oxide ($Al_2O_3$)
(7) Silicon dioxide ($SiO_2$)
(8) Calcium oxide (CaO)
(9) Iron oxide ($Fe_2O_3$)
(10) Magnesium oxide (MgO)
(11) Manganese oxide (MnO)
(12) Sodium monoxide ($Na_2O$)
(13) Phosphorus pentoxide ($P_2O_5$)
(14) Titanium oxide (TiO)
(15) Cobalt oxide (CoO)
(16) Sulfur (S)

[Table 2]

Analyzing method (1) Items (1) to (3) in Table 1
  1. Specific surface area measurement
     Apparatus: QUANTA SORB OS-8 manufactured by QUANTA CHROME
     Measuring conditions: DET-1 point method, flow method, and TCD method
     Pretreatment: 250° C.×15 min in $N_2$
  2. Mercury penetration method pore distribution measurement (PD)
     Apparatus: KARURO ERUBA Type 2200
(2) Moisture content . . . Bottom material investigation method and explanation of it—1984 1.2.3
(3) Ignition loss . . . Bottom material investigation method and explanation of it—1984 1.2.4
(4) Items (6) to (16) in Table 1 . . . High-frequency inductive coupling plasma emission spectroscopic analysis method.

TABLE 3

Analysis result

| Item | Result | Item | Result |
|---|---|---|---|
| Specific surface area measurement | 37.8 $m^2/g$ | Iron oxide ($Fe_2O_3$) | 4.1 w% |
| Pore volume measurement | 0.324 ml/g | Magnesium oxide (MgO) | 1.6 w % |
| Average pore radius | 500 Å | Manganese oxide (MnO) | 0.04 w % |
| Moisture content | 8.4 w % | Sodium monoxide ($Na_2O$) | 0.05 w % |
| Ignition loss | 4.2 w % | Phosphorus pentoxide ($P_2O_5$) | 0.07 w % |
| Aluminum oxide ($Al_2O_3$) | 13.0 w% | Titanium oxide (TiO) | 0.16 w % |
| Silicon dioxide ($SiO_2$) | 55.0 w % | Cobalt oxide (CoO) | 0.06 w % |
| Calcium oxide (CaO) | 3.6 w % | Sulfur (S) | 1.1 w % |

is composed of 13.0-w % aluminum, 55.0-w % silicon dioxide, 3.6-w % calcium, 4.1-w % iron oxide, 1.6-w % magnesium, 0.04-w % manganese, 0.05-w % sodium, 0.07-w % phosphorus, 0.16-w % titanium, 0.06-w % cobalt, and 1.1-w % sulfur.

Also, from Table 3, the soft porous ancient marine humus has the following characteristics: a specific surface area of 37.8 $m^2/g$, a pore volume of 0.324 ml/g, an average pore radius of 500 Å, a moisture content of 8.4 w %, and an ignition loss of 4.2 w %.

Next, the function of the combustion promotion auxiliary device of the present embodiment will be described.

Figure 2:
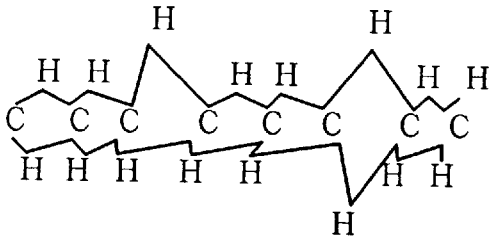
FIG. 2 is an illustration of the molecular structure of fuel before the combustion promotion auxiliary device for internal combustion engines of the first embodiment is employed.
Figure 3:
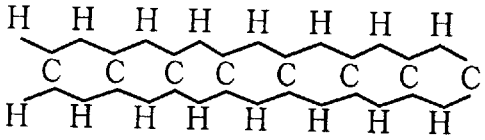
FIG. 3 is an illustration of the molecular structure of the fuel after the combustion promotion auxiliary device for internal combustion engines that of the first embodiment is employed.

FIG. 2 shows the molecular structure of gasoline, the fuel, before being passed through the combustion promotion auxiliary device of the present embodiment, and FIG. 3 shows the molecular structure of gasoline after being passed through the combustion promotion auxiliary device.

In the state as shown in FIG. 2, incomplete combustion is caused due to twisting or bending of the molecular structure containing carbon and hydrogen. On the other hand, in the state as shown in FIG. 3, the action of the soft porous ancient marine humus, which is a substance plentifully providing far infrared radiation, the ceramic powder, which provides far infrared radiation, and the magnet changes the state of the molecular structure containing carbon and hydrogen into an aligned one, providing complete combustion, thus improving the fuel combustion efficiency, and reducing the amount of incombustible exhaust substances, and the vibration and noise of the engine. Because the combustion efficiency is increased, the output efficiency of the engine is enhanced with fuel being saved.

In addition, the service life of the engine and that of the equipment are extended. The amounts of CO, HC, and NOx contained in the exhaust gas are decreased with the exhaust of incombustible substances being reduced, thus the degree of air pollution can be lowered.

Next, results of running tests of automobiles that are equipped with combustion promotion auxiliary devices of the present embodiment aspect will be described.

Running tests were conducted for three different passenger cars, the Nissan Cima, Toyota Crown, and Benz 300E, which are manufactured by the Nissan Motor, Toyota Motor, and Daimler-Benz, respectively, and a 10-t truck (used by Web Express) mainly for fuel consumption rate. Table 4 gives the results of the running test of the Nissan Cima, Table 5 that of the Toyota Crown, and Table 6 that of the Benz.

TABLE 4

| | |
|---|---|
| Car type | Nissan Cima |
| Year model | 1992 |
| Full exhaust amount | 4100 cc, gasoline using car |
| Total running distance | 87,459 km |
| Average running distance per liter | 5.5 km/l |
| Running test road | between Takanawa, Minato-ku, Tokyo and Itoh-city, Shizuoka-pref. |
| Running distance | 298 km |
| Gasoline consumption | 39 l |
| Running distance per liter | 7.64 km/l |
| Test result: | |
| ① Fuel consumption rate | 38.9% improved |
| ② Exhaust gas CO and HC | 0% |

TABLE 5

| | |
|---|---|
| Car type | Toyota Crown |
| Year model | 1990 |
| Full exhaust amount | 4000 cc, gasoline using car |
| Total running distance | 86,822 km |
| Average running distance per liter | 6.0 km/l |
| Running test road | between Takanawa, Minato-ku, Tokyo and Itoh-city, Shizuoka-pref. |
| Running distance | 187.1 km |
| Gasoline consumption | 21.36 l |
| Running distance per liter | 8.77 km/l |
| Test result: | |
| ① Fuel consumption rate | 46.2% improved |
| ② Exhaust gas CO and HC | 0% |

TABLE 6

| | |
|---|---|
| Car type | Mercedes Benz |
| Year model | 1992 |
| Full exhaust amount | 3000 cc, gasoline using car |
| Total running distance | 72,558 km |
| Average running distance per liter | 6.0 km/l |
| Running test road | between Takanawa, Minato-ku, Tokyo and Itoh-city, Shizuoka-pref. |
| Running distance | 287 km |
| Gasoline consumption | 33.4 l |
| Running distance per liter | 8.59 km/l |
| Test result: | |
| ① Fuel consumption rate | 43.2% improved |
| ② Exhaust gas CO and HC | 0% |

As can be seen from Table 4 to Table 6, it could be confirmed that the fuel consumption rate is improved by 38.9% for the Nissan Cima, 46.2% for the Toyota Crown, and 43.2% for the Benz.

The CO and HC in the exhaust was 0% for each of the Nissan Cima, Toyota Crown, and Benz.

With a 10-t truck (used by Web Express), 721 liters of fuel was required to be fed per 1600 km of running distance, the average fuel consumption rate being 2.21 km/liter, in the state in which the combustion promotion auxiliary device of the present embodiment aspect is not employed, while, in the state in which the combustion promotion auxiliary device of the present embodiment aspect is employed, 729 liters was needed per 1923 km of running distance, thus the average fuel consumption rate having been improved to 2.63 km/liter.

With the above described combustion promotion auxiliary device, the fuel combustion efficiency is improved, thus, the vibration and noise of the internal combustion engine are reduced, and because the combustion efficiency is increased, the output efficiency for the engine is enhanced with fuel being saved, and the service life of the engine and that of accessory equipment can be extended.

The amounts of CO, HC, and NOx contained in the exhaust gas are decreased with the exhaust of incombustible substances being reduced, thus the degree of air pollution can be lowered.

This invention is not limited to the above-stated first embodiment, and permits various variants to be employed.

With the above-stated first embodiment, an application where a combustion promotion medium 2 consisting of soft porous ancient marine humus, ceramic powder, and a magnet is used is described, however, as stated above, a combustion promotion medium 2 consisting of only soft porous ancient marine humus, a combustion promotion medium 2 consisting of a combination of soft porous ancient marine humus with ceramic powder, or a combustion promotion medium 2 consisting of a combination of soft porous ancient marine humus with a magnet can, of course, be used as the combustion promotion medium 2.

For these applications where a characteristic combustion promotion medium 2 is used, respectively, the same description that is given for the application where a combustion promotion medium 2 consisting of soft porous ancient marine humus, ceramic powder, and a magnet is used is applicable.

(Second Embodiment)

Next, a second embodiment will be described by referring to FIG. 4 to FIG. 9.

Figure 4:
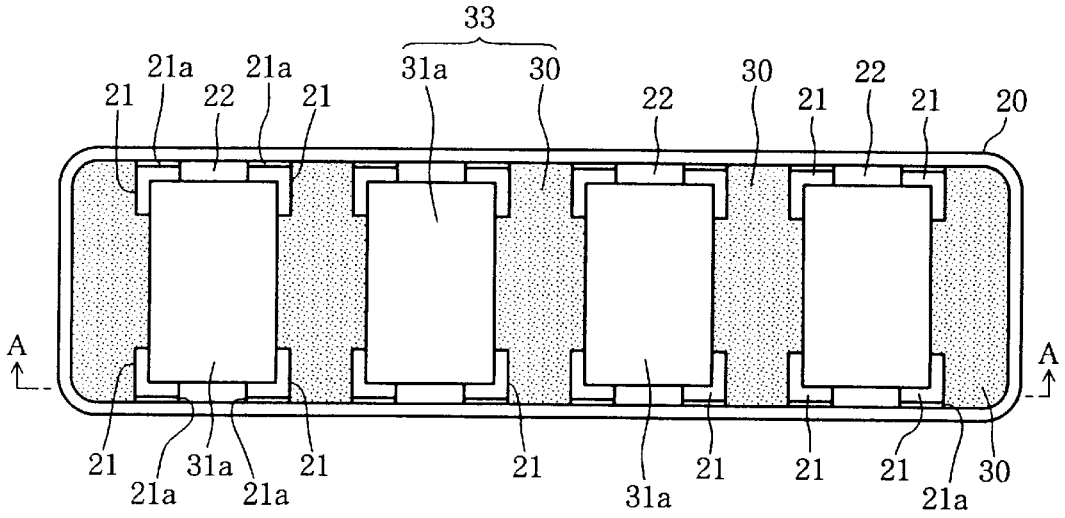
FIG. 4 is a schematic plan view of the combustion promotion auxiliary device for internal combustion engines of a second embodiment.
Figure 5:
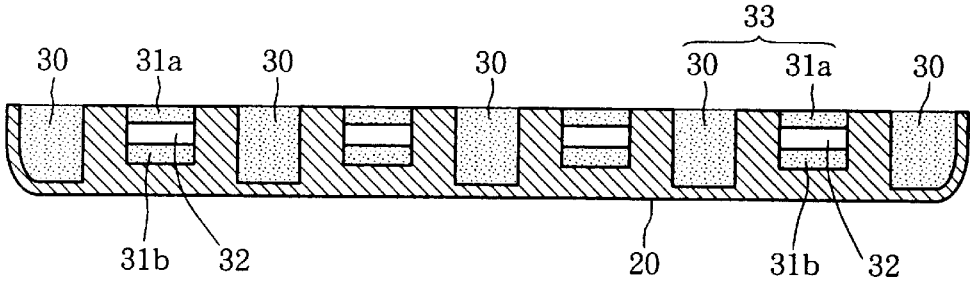
FIG. 5 is a sectional view along line A—A of FIG. 4.

The combustion promotion auxiliary device as shown in FIG. 4 and FIG. 5 is equipped with a combustion promotion auxiliary container 20 that is mounted to said (refer to the first embodiment) fuel pipe 11 and return pipe 12 composing a fuel supply system in a variety of internal combustion engines for automobiles, motorbikes, and others, the top of which is opened, that is nearly a rectangular prism in shape, and whose inside is partitioned into four areas with a certain spacing by L-shaped, for example, partitioning pieces 21 arranged by fours to be opposed to one another, providing magnet accommodating sections 22; and a combustion promotion medium 33 consisting of soft porous ancient marine humus 30 separated and housed in five areas other than said magnet accommodating sections 22 and magnet plates 31*a* and 31*b* having a double structure to sandwich an iron plates 32 between them, which is made of a ferromagnetic material, and being accommodated in said magnet accommodating sections 22.

In the connecting portion of each partitioning piece 21 for said combustion promotion auxiliary container 20 to the inner peripheral surface of this combustion promotion auxiliary container 20, an engaging groove 21*a* is provided in the direction along said inner peripheral surface.

The magnet plates 31*a* and 31*b* having a double structure to sandwich an iron plate 32 between them, which is made of a ferromagnetic material, and being accommodated in said magnet accommodating section 22 apply a magnetic field to said fuel pipe 11 and return pipe 12 in the state in which the magnetic lines are concentrated by the action of the iron plate 32, and by this, the combustion promotion auxiliary container 20 itself is securely attached to the fuel pipe 11 and return pipe 12 (when the fuel pipe 11 and return pipe 12 are made of such a magnetic material as a ferrous material and stainless steel).

Here, the results of experiment of the soft porous ancient marine humus 30 for intensity and emissivity of far infrared radiation when compared to a black body will be described by referring to FIG. 6 to FIG. 9.

The infrared rays are divided into two groups: near infrared rays, which have a wavelength of 0.75 $\mu$m to 4.0 $\mu$m, and far infrared rays, which have a wavelength of 4.0 $\mu$m to 1000 $\mu$m.

Figure 6:
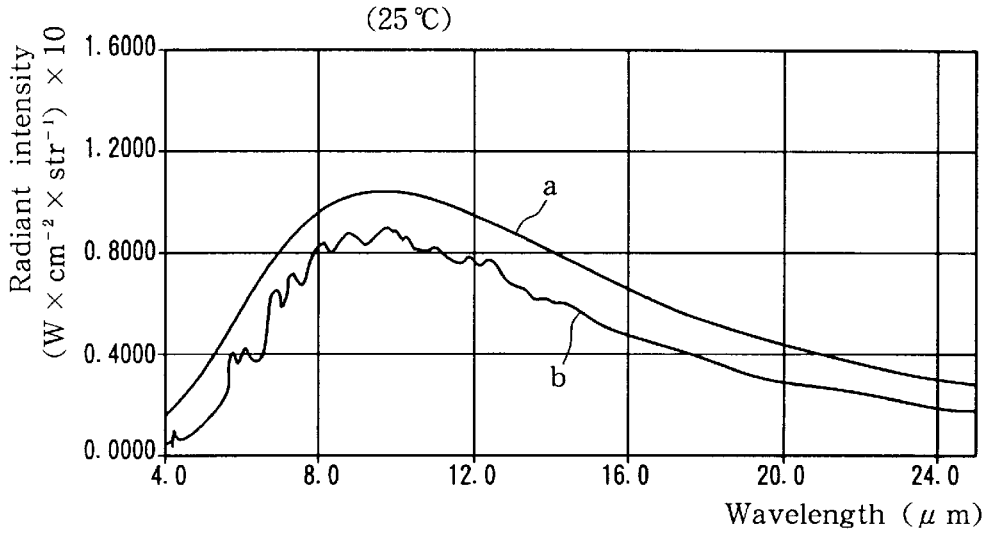
FIG. 6 is a graph showing the relationship between the wavelength and the radiant intensity when the soft porous ancient marine humus of the second embodiment of the present invention is calcined.
Figure 7:
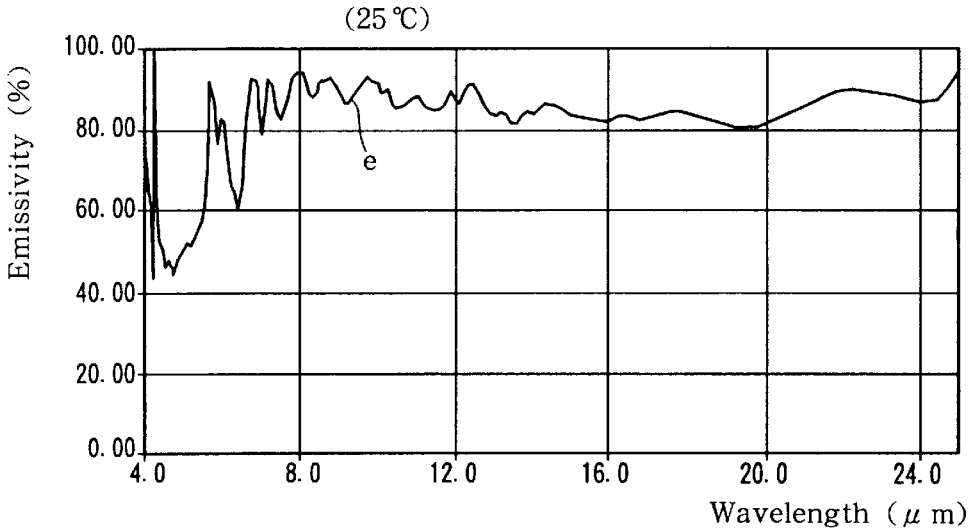
FIG. 7 is a graph showing the relationship between the wavelength and the emissivity when the soft porous ancient marine humus of the second embodiment of the present invention is calcined.
Figure 8:
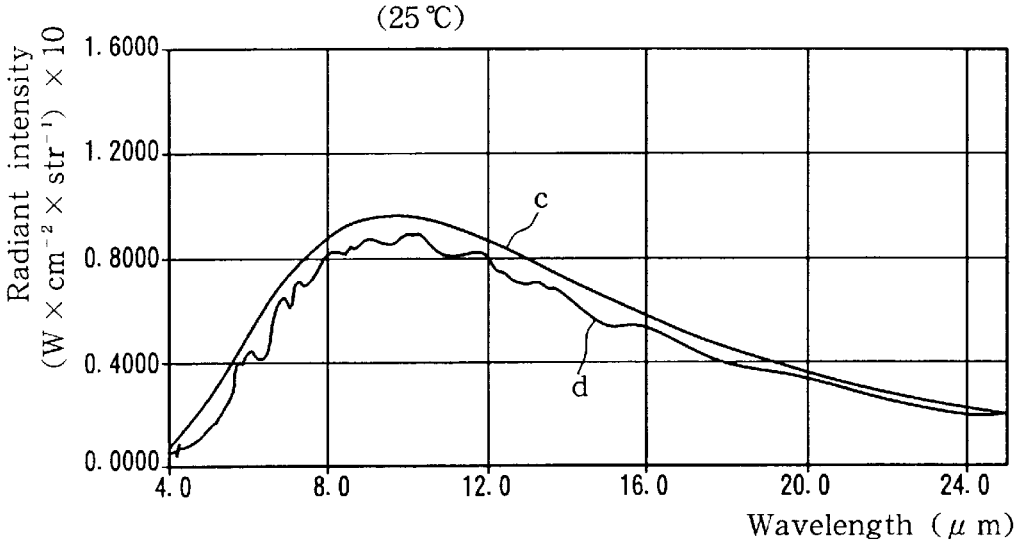
FIG. 8 is a graph showing the relationship between the wavelength and the radiant intensity when the soft porous ancient marine humus of the second embodiment of the present invention is not calcined.
Figure 9:
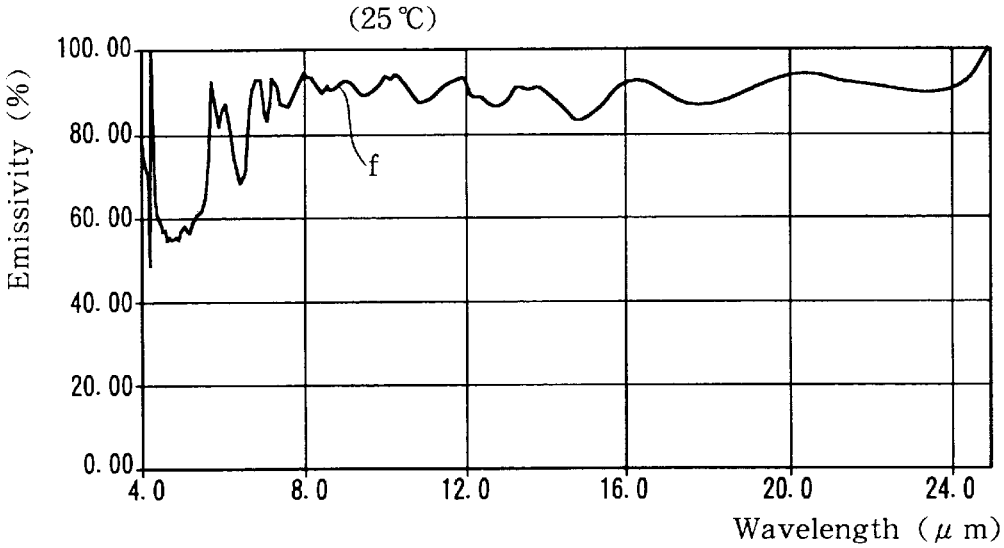
FIG. 9 is a graph showing the relationship between the wavelength and the emissivity when the soft porous ancient marine humus that is of the second embodiment of the present invention is not calcined.

The soft porous ancient marine humus 30 is a substance that plentifully provides said: infrared radiation, and the results of measurement of the black body, which is an ideal substance, and this soft porous ancient marine humus 30 for radiant intensity by using a Fourier transformation type infrared radiation spectrophotometer (JIR-E500) is shown in FIG. 6 and FIG. 8, and the results of comparison of the black body with the soft porous ancient marine humus 30 for emissivity is shown in FIG. 7 and FIG. 9.

The measuring condition with a Fourier transformation type infrared radiation spectrophotometer (JIR-E500) was to keep the black body and the soft porous ancient marine humus 30 at the same temperature (25° C.) for measuring the emissivity (radiation spectrum) of both. In this case, the resolution of the Fourier transformation type infrared radiation spectrophotometer was 1/16 cm, the number of data integration times was 200, and the detector used was an MCT.

The data "a" in FIG. 6 shows the radiant intensity [in $(W\times cm^{-2}\times str^{-1})\times 10$] of the far infrared radiation with a wavelength of 4.0 $\mu$m to 24 $\mu$m for a black body, while the data "b" in FIG. 6 shows the radiant intensity of the far infrared radiation with a wavelength of 4.0 $\mu$m to 24 $\mu$m for the soft porous ancient marine humus 30 that is calcined.

The data "c" in FIG. 8 shows the radiant intensity [in $(W\times cm^{-2}\times str^{-1})\times 10$] of the far infrared radiation with a wavelength of 4.0 $\mu$m to 24 $\mu$m for a black body, while the data "d" in FIG. 8 shows the radiant intensity of the far infrared radiation with a wavelength of 4.0 $\mu$m to 24 $\mu$m for the soft porous ancient marine humus 30 that is not calcined. The data "e" in FIG. 7 shows the ratio of data "b" to data "a" in FIG. 6, i.e., the emissivity (%) at a wavelength of 4.0 $\mu$m to 24 $\mu$m of the soft porous ancient marine humus 30 that is calcined.

The data "f" in FIG. 9 shows the ratio of data "d" to data "c" in FIG. 8, i.e., the emissivity (%) at a wavelength of 4.0 $\mu$m to 24 $\mu$m of the soft porous ancient marine humus 30 that is not calcined.

As can be seen from a comparison of FIG. 6 with FIG. 8, the soft porous ancient marine humus 30 that is not calcined offers practically the same radiant intensity as that of soft porous ancient marine humus 30 that is calcined, and as can be seen from a comparison of FIG. 7 with FIG. 9, the soft porous ancient marine humus 30 that is not calcined offers basically the same emissivity as that of the soft porous ancient marine humus 30 that is calcined.

Therefore, with the second embodiment of the present invention, it is considered that the calcined soft porous ancient marine humus 30 is higher in cost due to the calcining process, and the soft porous ancient marine humus 30 that is not calcined is used.

With the combustion promotion auxiliary device of the second embodiment, the fuel combustion efficiency is improved as is the case with the combustion promotion auxiliary device of the first embodiment, thus, the vibration and noise of the internal combustion engine are reduced, and because the combustion efficiency is increased, the output efficiency for the engine is enhanced with the fuel being saved, and the service life of the engine and that of the accessory equipment can be extended.

The amounts of CO, HC, and NOx contained in the exhaust gas are decreased with the exhaust of incombustible substances being reduced, thus the degree of air pollution can be lowered.

In addition, said magnet plates 31*a* and 32*b* allow this combustion promotion auxiliary device to be directly attached to the fuel pipe 11 and the return pipe 12, thus providing convenience for a mounting operation.

(Third Embodiment)

Next, the third embodiment will be described by referring to FIG. 10.

Figure 10:
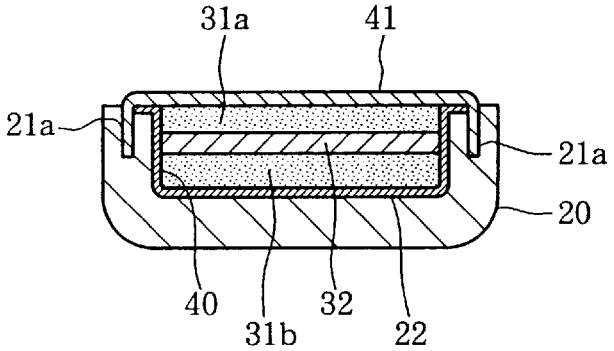
FIG. 10 is an enlarged sectional view of the combustion promotion auxiliary device for internal combustion engines of a third embodiment.

The combustion promotion auxiliary device as shown in FIG. 10 is characterized in that it is equipped with a gasket 40 made of rubber and laid on the internal wall of said magnet accommodating sections 22 and a rectangular lid 41 made of copper to cover the opening of the combustion promotion auxiliary container 20 in addition to the configuration of the previously described combustion promotion auxiliary device of the second embodiment. The edges at both ends in the longitudinal direction of this lid 41 are engaged with the engaging grooves 21*a* in said combustion promotion auxiliary container 20 so as to cover the opening of the combustion promotion auxiliary container 20, and to be tightly contacted with the ends of said gasket 40.

With this combustion promotion auxiliary device, said gasket 40 allows the magnet plates 31*a* and 31*b* in the magnet accommodating sections 22 to be held in place, and by bringing the lid 41 into tight contact with the gasket 40 made of rubber, rainwater and other foreign matters entering the magnet accommodating sections 22 can be prevented.

(Fourth Embodiment)

Next, the fourth embodiment will be described by referring to FIG. 11.

Figure 11:
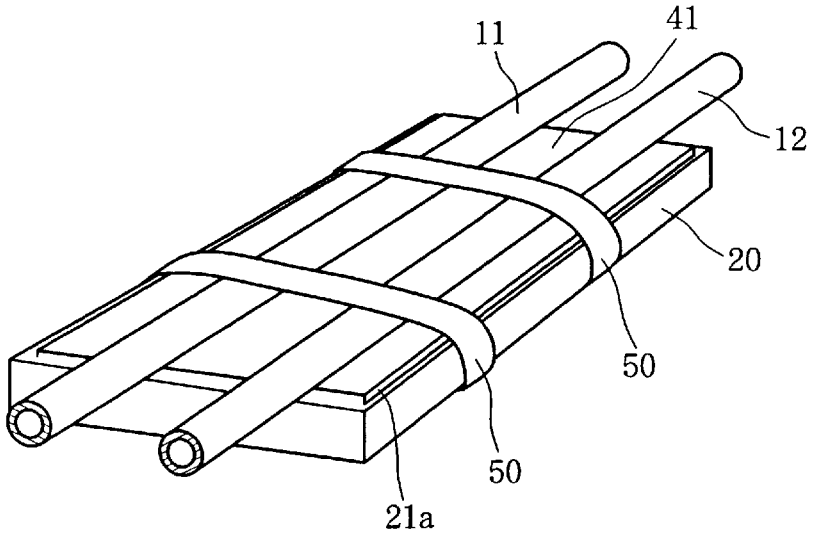
FIG. 11 is an oblique view of the combustion promotion auxiliary device for internal combustion engines of a fourth embodiment.

With the combustion promotion auxiliary device as shown in FIG. 11, a pair of band fittings, 50, made of steel, for example, for mounting the combustion promotion auxiliary container 20 covered with said lid 41 to the fuel supply system for an internal combustion engine is added to the configuration of the previously described combustion promotion auxiliary device of the third embodiment.

With this combustion promotion auxiliary device, a pair of band fittings, 50, for mounting the combustion promotion auxiliary container 20 to the fuel pipe 11 and the return pipe 12 in the fuel supply system for an internal combustion engine are provided, thus, if said fuel pipe 11 and return pipe 12 are made of such a non-magnetic material as rubber, the pair of band fittings, 50, can be used to easily mount and fix this combustion promotion auxiliary device to the fuel pipe 11 and the return pipe 12.

This invention is not limited to the above-stated embodiments and permits various variants to be employed.

The above-described invention can offer combustion promotion auxiliary devices for internal combustion engines with which the fuel combustion efficiency for a variety of internal combustion engines, such as automobile and motorbike engines, is improved, thus, the vibration and noise of the internal combustion engine are reduced, and because the combustion efficiency is increased, the output efficiency for a variety of internal combustion engines, such as automobile and motorbike engines, is enhanced with fuel being saved, and the service life of the internal engine and that of the accessory equipment can be extended.

Also, they can offer combustion promotion auxiliary devices for internal combustion engines with which the amounts of CO, HC, and NOx contained in the exhaust gas are decreased with the exhaust of incombustible substances being reduced, thus the degree of air pollution can be lowered.

The invention can offer combustion promotion auxiliary devices for internal combustion engines that provide the same effect as stated above, and, in addition, can be easily mounted to the fuel supply system for the internal combustion engine in automobiles, motorbikes, and others without hindrance by utilizing the magnetic force of the magnet plates when the fuel pipe and the return pipe in the fuel supply system for the internal combustion engine in automobiles, motorbikes, and others are made of a magnetic substance, or by utilizing the band fittings when the fuel pipe and the return pipe are made of a non-magnetic material.

Also, they can offer combustion promotion auxiliary devices for internal combustion engines that can prevent rainwater and other foreign matters from entering the combustion promotion auxiliary device.

What is claimed is:

1. A combustion promotion auxiliary device for internal combustion engines comprising a combustion promotion auxiliary container which can be mounted to a fuel supply system in a variety of internal combustion engines for automobiles, motorbikes, and others, and a combustion promotion medium consisting of soft porous ancient marine humus housed in said combustion promotion auxiliary container.

2. A combustion promotion auxiliary device for internal combustion engines comprising a combustion promotion auxiliary container which can be mounted to a fuel supply system in a variety of internal combustion engines for automobiles, motorbikes, and others, and a combustion promotion medium consisting of soft porous ancient marine humus and ceramic powder housed in said combustion promotion auxiliary container.

3. A combustion promotion auxiliary device for internal combustion engines comprising a combustion promotion auxiliary container which can be mounted to a fuel supply system in a variety of internal combustion engines for automobiles, motorbikes, and others, and a combustion promotion medium consisting of soft porous ancient marine humus and a magnet housed in said combustion promotion auxiliary container.

4. A combustion promotion auxiliary device for internal combustion engines comprising a combustion promotion auxiliary container which can be mounted to a fuel supply system in a variety of internal combustion engines for automobiles, motorbikes, and others, and a combustion promotion medium consisting of soft porous ancient marine humus, ceramic powder, and a magnet housed in said combustion promotion auxiliary container.

5. A combustion promotion auxiliary device for internal combustion engines comprising a combustion promotion auxiliary container which can be mounted to a fuel supply system in a variety of internal combustion engines for automobiles, motorbikes, and others, the top of which is opened, and whose inside is partitioned into more than one area with a certain spacing, providing magnet accommodating sections, and a combustion promotion medium consisting of soft porous ancient marine humus sectioned and housed in areas other than said magnet accommodating sections in said combustion promotion auxiliary container, and magnetic plates housed in said magnet accommodating sections.

6. A combustion promotion auxiliary device for internal combustion engines comprising a combustion promotion auxiliary container which can be mounted to a fuel supply system in a variety of internal combustion engines for automobiles, motorbikes, and others, the top of which is opened, whose inside is partitioned into more than one area with a certain spacing, providing magnet accommodating sections, and which has a gasket made of rubber and laid on an internal wall of said magnet accommodating sections, a combustion promotion medium consisting of soft porous ancient marine humus sectioned and housed in areas other than said magnet accommodating sections in said combustion promotion auxiliary container, and magnetic plates housed in said magnet accommodating sections, and a lid to cover the opening of the top of said combustion promotion auxiliary container in which said combustion promotion medium is housed.

7. A combustion promotion auxiliary device for internal combustion engines comprising a combustion promotion auxiliary container which can be mounted to a fuel supply system in a variety of internal combustion engines for automobiles, motorbikes, and others, the top of which is opened, whose inside is partitioned into more than one area with a certain spacing, providing magnet accommodating sections, and which has a gasket made of rubber and laid on an internal wall of said magnet accommodating sections, a combustion promotion medium consisting of soft porous ancient marine humus sectioned and housed in areas other than said magnet accommodating sections in said combustion promotion auxiliary container, and magnetic plates housed in said magnet accommodating sections, a lid to cover the opening of the top of the combustion promotion auxiliary container in which said combustion promotion medium is housed, and band fittings to mount said combustion promotion auxiliary container covered with said lid to the fuel supply system for an internal combustion engine.

* * * * *